United States Patent [19]

Miller

[11] Patent Number: 4,801,147

[45] Date of Patent: Jan. 31, 1989

[54] METHOD OF PLAYING A BOARD GAME

[76] Inventor: James R. Miller, 7600 Manchester Ave., Apt. 211, Playa Del Rey, Calif. 90293

[21] Appl. No.: 70,339

[22] Filed: Jul. 6, 1987

Related U.S. Application Data

[62] Division of Ser. No. 896,643, Aug. 15, 1986, abandoned.

[51] Int. Cl.[4] ..... A63F 3/00

[52] U.S. Cl. ..... 273/276; 273/236; 273/275

[58] Field of Search ..... 273/236, 276, 267, 271, 273/275, 272, 157 R, 258; 434/96

[56] References Cited

U.S. PATENT DOCUMENTS

| | | | |
|---|---|---|---|
| 3,191,937 | 6/1965 | Kropinski | 273/275 |
| 3,267,590 | 8/1966 | Browning | 273/272 |
| 4,298,200 | 11/1981 | Konbor | 273/157 R |

*Primary Examiner*—Richard C. Pinkham

*Assistant Examiner*—Benjamin Layno

*Attorney, Agent, or Firm*—John J. Posta, Jr.

[57] ABSTRACT

A game board bearing indicia defining a plurality of adjoining game spaces, a plurality of sets of distinctive markers for placing in the spaces to progressively outline design patterns allotted to the various game players by radomly drawing game cards bearing the patterns, and design pattern-making pads, score-keeping pads and game rules. In accordance with the method of play, order of play by the players is first determined, then the individual design patterns are drawn by card by the players, after which each player secretly determines where to outline the selected pattern on the game board and secretly records that selection on a pattern-recording sheet. Thereupon, each player, in turn, places a marker on a space on the game board in order to progressively complete that player's pattern. Points are awarded for first finishing a pattern, blocking another player's pattern and first reaching an intersection of patterns. The player who first accumulates a predetermined point total or completes a pattern wins.

4 Claims, 1 Drawing Sheet

METHOD OF PLAYING A BOARD GAME

This is a division, of application Ser. No. 896,643, filed 8/15/86 and now abandoned.

BACKGROUND OF THE INVENTION

1. Field of the Invention

The present invention generally relates to games and, more particularly, to a novel board game and game playing method.

2. Prior Art

Various types of board games have been devised, certain of which involve the use of markers proceeding over a multi-spaced course to a winning goal (see Chinese checkers, checkers, chess and the like). Other board games involve the acquisition of points (see Monopoly, for example) by gambling procedures (throwing of dice, etc.) in order to provide a player with a winning total. Still another board game involves the sequential drawing and placing of letters in order to form words on the board playing squares (various forms of Scrabble).

It would be desirable to provide a new and different board game and method of play which would not necessitate the use of dice or other gambling procedures throughout the game, but still would provide suspense, action and visual and intellectual stimulation. Such a game should be inexpensive, durable, portable and capable of being played by two or more players, singly and in teams, and should also be capable of being played with various modified forms of rules, to suit the particular desires of the players.

SUMMARY OF THE INVENTION

The improved board game and method of play of the present invention satisfy all the foregoing needs. The game and method are substantially as set forth in the Abstract. Thus, the game includes a game board uniformly divided into a number of spaces upon which player markers are placed to outline design patterns selected by the players by a secret card draw. The markers are in sets bearing distinctive indicia to identify the players. Each card bears a different design pattern on one side thereof, the placement of which pattern by the player on the game board being secretely determined and recorded on that player's pattern-recording sheet. A tally sheet is also provided for each player, and the game also comes with a set of rules explaining the proper method of play.

In accordance with the method, the players first draw to determine the order of play; that is, the order in which the players place their markers, one at a time, on the game board, using their distinctive sets of markers. The pattern cards are then secretely drawn from the stack of cards provided with the game, the patterns are secretely recorded on the player-recording sheets and then play begins.

The first player to outline that player's pattern on the board in the spaces is awarded a predetermined number of points. Other points are awarded for blocking another player's pattern and for first landing on a space which intersects the player's and another player's patterns. Play may continue and be repeated until a player reaches a predetermined winning total or first completes his pattern. Team play can also be carried out.

Various other features of the game and method are set forth in the following detailed description and accompanying drawings.

DRAWINGS

FIG. 1, the single FIGURE, schematically depicts a preferred embodiment of the improved board game of the present invention, including a multi-spaced game board, 8 sets of markers, a rules book, and a combined tally pad and pattern-recording pad; FIG. 1 also shows two typical geometrical patterns outlined on the game cards and game board.

DETAILED DESCRIPTION

FIG. 1

Figure 1:
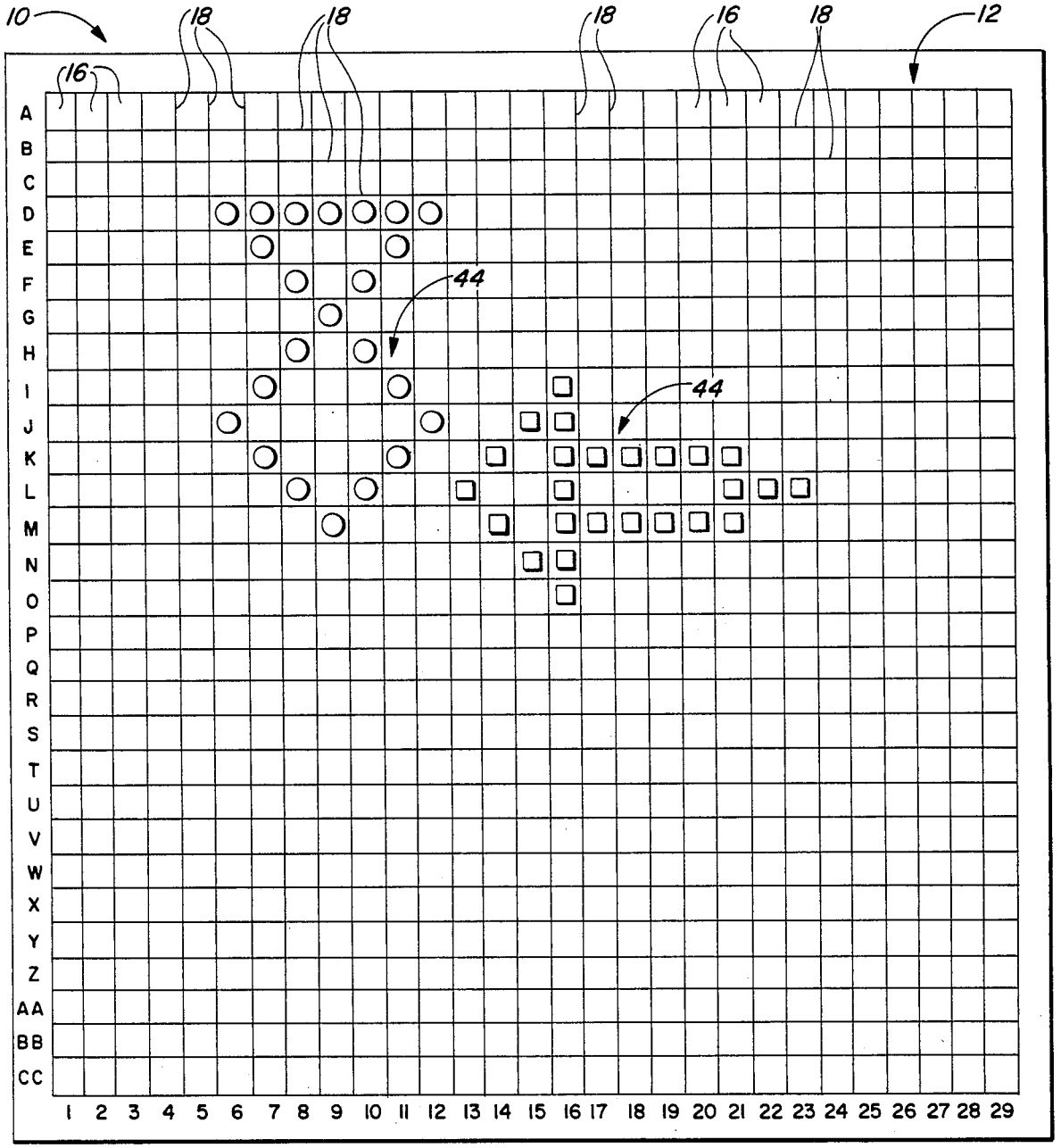
Figure 1:
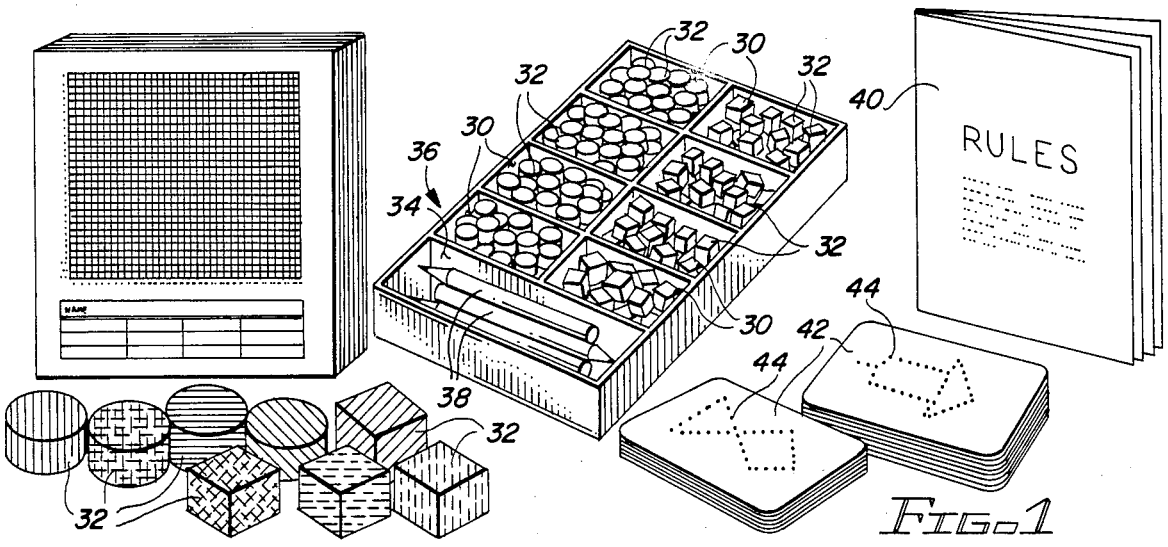

Now referring more particularly to the accompanying drawings, the single figure schematically depicts a preferred embodiment of the improved board game of the present invention. Thus, FIG. 1 shows game 10 which includes a flat game board 12 of wood, metal, plastic, cloth, or the like, preferably square in shape and bearing space-defining indicia on the upper surface 14 thereof. Thus, surface 14 is divided into a number of spaces 16 by a plurality of intersecting vertical and horizontal lines 18.

In the embodiment of FIG. 1, board 12 is square, as are spaces 16 and there are 29 spaces in each of 29 horizontal rows disposed above one another for a total of $29 \times 29 = 841$ playing spaces 16. It will be understood that board 12 could be rectangular, circular or another shape and that spaces 16 could be arranged in other than 29 rows of 29 spaces each. Horizontal indicia 20 numbered 1 through 29 below the individual squares 16 of the lowermost horizontal row and vertical indicia 22 lettered A through CC and disposed on the left margin of board 12 adjacent to the individual vertical squares 16 serve to enable a player to locate each square 16 on board 12, as well as on the miniaturized version of board 12 depicted on each sheet 24 of pattern-recording pad 26 supplied with game 10. Each sheet 24 may also include a tally portion 28 for keeping a running total of points scored during play of game 10. It will be understood that pad 26 could be eliminated, if desired.

Game 10 also contains a plurality of sets 30 of markers 32. Each set 30 can be stored in a different section 34 of box 36, if desired, and each set 30 bears indicia which distinguish it from each other set 30 supplied with game 10. Thus, each set 30 can be of different color and/or shape. As depicted in FIG. 1, the markers 32 within each set 30 are uniform and the markers of the various sets 30 can differ from each other in shape with, for example, one set 30 having round topped markers, and the others having square shaped markers 32 which can be of differing colors. The total number of markers 32 per set 30 will depend on the number of spaces 16 and the number of markers 32 needed per pattern. Usually, up to thirty or more markers 32 are provided per set 30. Box 36 may also include a section 34 containing scoring pens or pencils 38 or the like.

Game 10 preferably further includes a pamphlet 40 containing a set of rules for playing game 10 and must include a deck of cards 42. Each card 42 bears a different geometrical design pattern 44, such as are depicted in FIG. 1. It will be understood that, if desired, each pattern 44 could be one or more word or phrases instead of a geometrical or artistic design or the like. In any event, each pattern 44 is depictable on board 12 by deploying a fixed number of markers 32, for example, thirty markers, on the desired squares 16, as shown, one per square 16. It will be further understood that, if desired, board 12 could be used and game 10 played by placing markers 32 on the intersections of lines 18 rather than on spaces 16. The result would be the same.

In accordance with the method of the present invention, game 10 is played by first determining the order of play of the 2 or more players (preferably, 2–8,) who will be playing game 10. This can be done by having the players blind draw markers 32 from different sets 30, with the various sets 30 being preassigned different ranks or order of priority of play. The players then use the same set 30 of markers 32 as they have blind drawn to play the game. Any type of random draw could readily be employed.

Before or after this blind draw, each of the players blind draws one of cards 42 to secretly select the pattern 44 which he or she will be attempting to complete with his or her markers 32 on board 12. Each player then secretly determines where that pattern 44 will go on board 12 and secretly enters that same pattern 44 and location on the appropriate spaces on the miniaturized version of board 12 depicted on a sheet 24 of pad 26.

The object of game 10 is to be the first to complete the outline of the selected pattern 44 on game board 12 and thus accumulate points towards a desired winning total (for example 45 points) or, alternatively, by first completing his pattern. In a preferred embodiment of the present method, a player completing his or her pattern before all other opponents accumulates 10 points and terminates that round of the game. Subsequent rounds are played in the previously described manner until a player reaches the winning total and is declared the winner.

In playing the game, the players deposit their markers one at a time in the order of play initially established by placing them in the previously selected spaces 16 on board 12. All patterns 44 require the same number of markers 32 to outline and thus complete the selected pattern. Accordingly, the first player to deposit any marker will finish his or her pattern before all other players unless his or her progress is blocked. It is therefore an object of the game for each player to select a position for his or her pattern which is most likely to block the progress of the other players towards completion of their patterns. In this regard, whenever any given player (x) places his or her marker on the path which another player must follow to complete his or her pattern, player X blocks player Y and gains 1 point for the block. Player Y must immediately declare that the block exists and must immediately (next moves) unblock. Failure by player Y to declare a block by player X and to immediately unblock will result in a penalty of 20 points being assessed against player Y when the failure is discovered.

To unblock, player Y must place X markers as close as possible in spaces 16 on opposite sides (2 moves) of the blocking marker 32 in those situations where spaces 16 are available on both sides of the blocking marker 32. When unblocked, the blocking marker 32 becomes part of the blocked players pattern. If that marker 32 is in a space 16 abutting the outer perimeter or edge of board 12, only one marker 32 can be used to unblock. This is done by placing it in the next adjacent side space 16 to the blocking marker 32.

Whenever two patterns 44, due to their location on board 12, will intersect each other on board 12, the first player to occupy such a cross-over point or intersecting space is awarded 5 points. At this point in time, the opposing player must advise his opponent that this is a cross-over point. In order to obtain that award, that player must ask the opponents if that space is a cross-over point. In so establishing the fact, the occupying player also obtains an idea of the secret pattern of the opponent who acknowledges the cross-over point. In one modification of the game, if a player asks if he or she has occupied a cross-over point and receives a negative replay, the asking player must deduct 1 point from his or her own score.

A running point total is kept by each player on portion 28 of his or her sheet 24. The patterns 44 on sheets 24 are used to verify that the patterns 44 are being correctly applied in spaces 16 of game board 12 and that blocking, unblocking and crossing over points are properly interpreted.

Accordingly, the game progresses in an orderly manner and in accordance with the present method. Team play can be carried out in accordance with the following rules:

TEAM PLAY

1. Teams of 2, 3 or 4 players may be formed. The combined score of the team members will determine the team score and the ultimate winning team.
2. All members of the same team will use the same or similar style markers.
3. All members of the same team will play alternatively with all members of the opposing team.
4. Members of the same team may reveal their patterns to other members of their team.
5. Members of the same team may assist each other in the formation of their patterns and in the general play of the game.
6. The first player to complete his or her pattern receives 10 points for each player on the team and remains playing to assist his or her fellow team members.
7. The second player of any team, regardless of the team he is on, who subsequently completes his/her pattern, will receive 5 points for each member of his/her team.
8. All other rules applicable to individual play also apply to team play.

Thus, game 10 is amusing, stimulating and challenging. Game 10 can also be played in various ways, other than as previously described, utilizing some or all of the equipment depicted in FIG. 1. Various modifications, changes, alterations and additions can be made in game 10, its equipment, components and parameters and in the present method and its steps. All such modifications, changes, alterations and additions as are within the scope of the appended claims form part of the present invention.

What is claimed is:

1. A method of playing a board game wherein the board game comprises a game board, a plurality of markers, a plurality of cards and a plurality of player design recording sheets, said game board having a plurality of squares set forth on one face thereof, said plurality of markers having indicia thereon distinguishing them into a plurality of sets, each of said plurality of cards having a distinctively different design pattern thereon, each of said player design recording sheets having designated thereon, a representation of said game board including a plurality of squares; the method of playing comprising the steps of:

(a) all players determining the order of play, (b) each player selecting markers so as to determine the markers to be used by each player during play of the game, (c) each player selecting a card from said plurality of cards, (d) each player secretly determining the position on the game board at which the player intends to locate the design pattern shown on the selected card, (e) each player secretly outlining the selected design pattern on one of said player design recording sheets, the position of said outline corresponding to the secretly determined position on the game board at which the player intends to locate the design pattern shown on the selected card, (f) each player, in the order of play, placing one of his markers on a square of the game board that corresponds to a square on said player design recording sheet that constitutes a portion of the outlined design pattern, (g) each of the players continuing the sequential placement of markers on the game board and said game ending when one of the players has covered every square on the game board that corresponds to a square on said player design recording sheet that constitutes a portion of the outlined design pattern.

2. A method of playing a game as set forth in claim 1 and further comprising the steps of placing two markers on either side of an opponent's marker or one marker on the board side of an opponent's marker if it is on the edge of the board when an opponent's marker occupies a square that forms part of another player's outlined design pattern, said method also comprising the steps of awarding a predetermined number of points to the opponent's piece that is blocking the other player's design and subtracting a certain number of points from the player whose square is blocked if that player does not immediately place the one or two markers on either side of the opponent's blocking piece.

3. A method of playing a game as set forth in claim 2 and further comprising the step of awarding a predetermined number of points to a player who first places his marker to occupy a cross-over point of intersection between his pattern and another player's pattern.

4. A method of playing a game as set forth in claim 3 and further comprising the steps of repeating the steps (c) through (g) of claim 1 until one of said players accumulates a preselected winning point total.

* * * * *